US009959698B2

(12) United States Patent
Fitzgerald et al.

(10) Patent No.: US 9,959,698 B2
(45) **Date of Patent: *May 1, 2018**

(54) ITEM DISPENSING APPARATUS

(71) Applicant: Innovative Product Achievements, LLC, Suwanee, GA (US)

(72) Inventors: Robert Fitzgerald, Suwanee, GA (US); Kyle Joiner, Roswell, GA (US); Joel Eisler, Lawrenceville, GA (US); Ward Broom, Snellville, GA (US); Keith Stallings, Dacula, GA (US); Jason Farah, Duluth, GA (US)

(73) Assignee: Innovative Product Achievements, LLC, Suwanee, GA (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/437,274

(22) Filed: Feb. 20, 2017

(65) Prior Publication Data

US 2017/0161983 A1 Jun. 8, 2017

Related U.S. Application Data

(63) Continuation of application No. 14/961,606, filed on Dec. 7, 2015, now Pat. No. 9,576,418, which is a (Continued)

(51) Int. Cl.
*G07F 11/00* (2006.01)
*G07F 11/62* (2006.01)
(Continued)

(52) U.S. Cl.
CPC ..... *G07F 11/62* (2013.01); *A47F 1/04* (2013.01); *A47F 3/001* (2013.01); *A47F 3/002* (2013.01);
(Continued)

(58) Field of Classification Search
None
See application file for complete search history.

(56) References Cited

U.S. PATENT DOCUMENTS 328,224 A 10/1885 Jacobson
2,202,358 A 5/1940 Stone
(Continued)

FOREIGN PATENT DOCUMENTS

CN 201236594 Y 5/2009
CN 201909966 U 7/2011
(Continued)

OTHER PUBLICATIONS

European Patent Office, Communication Pursuant to Article 94(3) EPC for Application No. 13779978.9, 4 pages, Germany.
(Continued)

*Primary Examiner* — Timothy R Waggoner
(74) *Attorney, Agent, or Firm* — Alston & Bird LLP

(57) ABSTRACT

Various embodiments of the present invention are directed to a dispenser configured for storing one or more items and dispensing the stored items to authorized users. According to various embodiments, the dispenser generally includes a housing defining an interior portion dimensioned to receive a plurality of items and an access assembly configured to prevent unauthorized user access to the interior portion of the dispenser while providing selective access to certain items in response to input received from an authorized user. According to various embodiments, the access assembly comprises a pair of flexible barriers coupled to a sliding door assembly, which includes one or more lockable access doors. Together, the door assembly and flexible barriers prevent access to the interior of the dispenser when in a locked configuration and permit access to certain items when in an unlocked configuration.

17 Claims, 14 Drawing Sheets

Related U.S. Application Data continuation of application No. 14/042,612, filed on Sep. 30, 2013, now Pat. No. 9,208,635.

(60) Provisional application No. 61/707,608, filed on Sep. 28, 2012.

(51) Int. Cl.

| | |
|---|---|
| ***G07F 9/10*** | (2006.01) |
| ***A61G 12/00*** | (2006.01) |
| ***E05B 47/02*** | (2006.01) |
| ***E05B 47/00*** | (2006.01) |
| ***A47F 1/04*** | (2006.01) |
| ***A47F 3/02*** | (2006.01) |
| ***A47F 5/01*** | (2006.01) |
| ***A47F 7/00*** | (2006.01) |
| ***A47F 3/00*** | (2006.01) |
| ***E05D 15/06*** | (2006.01) |

(52) U.S. Cl.

CPC ..... *A47F 3/02* (2013.01); *A47F 5/01* (2013.01); *A47F 7/00* (2013.01); *A61G 12/001* (2013.01); *E05B 47/0004* (2013.01); *E05B 47/023* (2013.01); *E05D 15/0621* (2013.01); *G07F 9/10* (2013.01); *A61G 2203/36* (2013.01); *E05B 2047/0068* (2013.01); *E05Y 2900/20* (2013.01)

(56) References Cited

U.S. PATENT DOCUMENTS

| | | | | |
|---|---|---|---|---|
| 3,055,419 | A | 9/1962 | Rubin et al. | |
| 3,058,320 | A | 10/1962 | Foster et al. | |
| 3,116,097 | A | 12/1963 | Novales | |
| 3,249,294 | A | 5/1966 | Hughes et al. | |
| 3,282,382 | A | 11/1966 | Thompson | |
| 3,392,543 | A | 7/1968 | Miller | |
| 3,439,725 | A | 4/1969 | Haimovitz | |
| 3,455,621 | A | 7/1969 | Kingsley | |
| 3,464,509 | A | 9/1969 | Gray | |
| 3,639,919 | A | 2/1972 | White | |
| 3,687,546 | A | 8/1972 | Endebrock et al. | |
| 3,690,118 | A | 9/1972 | Rainwater | |
| 3,712,363 | A | 1/1973 | Thomassen | |
| 3,719,408 | A | 3/1973 | Fullington | |
| 3,752,550 | A | 8/1973 | Niemeyer | |
| 3,785,669 | A | 1/1974 | Doheny | |
| 3,807,480 | A | 4/1974 | Smart | |
| 3,834,865 | A | 9/1974 | Lee | |
| 3,861,768 | A | 1/1975 | Wilson | |
| 3,961,675 | A | 6/1976 | Siegel | |
| 4,034,572 | A | 7/1977 | Morris et al. | |
| 4,037,526 | A | 7/1977 | Jaekle | |
| 4,073,369 | A | 2/1978 | Nordskog | |
| 4,077,228 | A | 3/1978 | Schumacher et al. | |
| 4,108,363 | A | 8/1978 | Susumu | |
| 4,192,436 | A | 3/1980 | Schuller et al. | |
| 4,281,730 | A | 8/1981 | Swersey et al. | |
| 4,365,854 | A | 12/1982 | Waller | |
| 4,401,216 | A | 8/1983 | Koch | |
| 4,491,375 | A | 1/1985 | Ugalde | |
| 4,509,577 | A | 4/1985 | Priefert | |
| 4,891,755 | A | 1/1990 | Asher | |
| 4,974,658 | A | 12/1990 | Komatsu et al. | |
| 4,976,301 | A | 12/1990 | Easley et al. | |
| 5,067,630 | A | 11/1991 | Nesser et al. | |
| 5,085,261 | A | 2/1992 | Bortoluzzi | |
| 5,163,495 | A | 11/1992 | Lichy | |
| 5,370,722 | A | 12/1994 | Simmons | |
| 5,379,823 | A | 1/1995 | Kraeutler | |
| 5,385,265 | A | 1/1995 | Schlamp | |
| 5,657,805 | A | 8/1997 | Magro | |
| 5,683,221 | A | 11/1997 | Ablabutyan | |
| 5,724,764 | A | 3/1998 | Alsup | |
| 5,875,597 | A | 3/1999 | Gingrich et al. | |
| 5,964,270 | A | 10/1999 | Kirkey et al. | |
| 5,971,512 | A | 10/1999 | Swan | |
| 6,024,153 | A | 2/2000 | Goldman | |
| 6,282,914 | B1 | 9/2001 | Steinhoff et al. | |
| 6,385,505 | B1 | 5/2002 | Lipps | |
| 6,394,738 | B1 | 5/2002 | Springer | |
| 6,397,916 | B1 | 6/2002 | Bengtsson et al. | |
| 6,409,187 | B1 | 6/2002 | Crow, Jr. | |
| 6,409,589 | B1 | 6/2002 | Laconico, Jr. et al. | |
| 6,450,598 | B1 | 9/2002 | Hänel | |
| 6,502,718 | B2 | 1/2003 | Fitzgerald et al. | |
| 6,510,566 | B2 | 1/2003 | Bryce | |
| 6,595,606 | B1 | 7/2003 | Gunst | |
| 6,615,894 | B1 | 9/2003 | McKeon | |
| 6,626,508 | B1 | 9/2003 | Hase et al. | |
| 6,848,491 | B2 | 2/2005 | Gambarelli et al. | |
| 6,910,302 | B2 | 6/2005 | Crawford | |
| 6,994,409 | B2 * | 2/2006 | Godlewski | A47B 63/06 312/215 |
| 7,134,242 | B2 | 11/2006 | Fitzgerald | |
| 7,282,652 | B1 | 10/2007 | Johnson et al. | |
| 7,353,658 | B2 | 4/2008 | Voute et al. | |
| 7,407,238 | B2 | 8/2008 | Fitzgerald | |
| 7,428,447 | B2 | 9/2008 | Stonikas et al. | |
| 7,628,410 | B2 | 12/2009 | Fitzgerald et al. | |
| 7,874,562 | B2 | 1/2011 | Fitzgerald et al. | |
| 8,229,802 | B2 | 7/2012 | Henry | |
| 8,744,621 | B2 * | 6/2014 | Michael | E05B 47/00 700/243 |
| 8,763,672 | B2 | 7/2014 | Smart et al. | |
| 9,208,635 | B2 * | 12/2015 | Fitzgerald | E05B 47/023 |
| 9,245,406 | B2 | 1/2016 | Fitzgerald et al. | |
| 9,576,418 | B2 * | 2/2017 | Fitzgerald | E05B 47/023 |
| 2002/0130135 | A1 | 9/2002 | Fitzgerald et al. | |
| 2003/0025424 | A1 | 2/2003 | Graves | |
| 2003/0221797 | A1 | 12/2003 | Schaller | |
| 2004/0004419 | A1 | 1/2004 | Godlewski | |
| 2004/0031574 | A1 | 2/2004 | Gambarelli et al. | |
| 2004/0206462 | A1 | 10/2004 | Fitzgerald et al. | |
| 2004/0245272 | A1 | 12/2004 | Fitzgerald et al. | |
| 2005/0060938 | A1 | 3/2005 | Fitzgerald | |
| 2006/0230683 | A1 | 10/2006 | Hung | |
| 2006/0250056 | A1 | 11/2006 | Fitzgerald | |
| 2006/0266770 | A1 | 11/2006 | Fitzgerald | |
| 2007/0073441 | A1 | 3/2007 | Stonikas et al. | |
| 2007/0080519 | A1 | 4/2007 | Murdock | |
| 2008/0001031 | A1 | 1/2008 | Doebertin et al. | |
| 2008/0272137 | A1 | 11/2008 | Fitzgerald et al. | |
| 2008/0272139 | A1 | 11/2008 | Fitzgerald | |
| 2008/0272141 | A1 | 11/2008 | Fitzgerald et al. | |
| 2008/0272564 | A1 | 11/2008 | Fitzgerald et al. | |
| 2008/0272565 | A1 | 11/2008 | Fitzgerald et al. | |
| 2013/0123978 | A1 | 5/2013 | Stark et al. | |
| 2013/0211585 | A1 | 8/2013 | Broom et al. | |
| 2014/0091684 | A1 | 4/2014 | Fitzgerald et al. | |
| 2014/0368100 | A1 | 12/2014 | Burd | |

FOREIGN PATENT DOCUMENTS

| | | | |
|---|---|---|---|
| EP | 0553470 | A1 | 8/1993 |
| EP | 1061013 | A1 | 12/2000 |
| EP | 1382273 | A1 | 1/2004 |
| JP | H06-045082 | A | 2/1994 |
| JP | 2004035267 | A | 2/2004 |
| JP | 2008-036143 | A | 2/2008 |
| JP | 2010-077709 | A | 4/2010 |

OTHER PUBLICATIONS

International Preliminary Examining Authority, International Preliminary Report on Patentability for International Application No. PCT/US2013/062764, dated Sep. 11, 2014, 6 pages, European Patent Office, Germany.

International Searching Authority, International Search Report and Written Opinion for International Application No. PCT/US2013/

(56) References Cited

OTHER PUBLICATIONS 062764, dated Jan. 16, 2014, 9 pages, European Patent Office, The Netherlands.
IP Australia, Patent Examination Report No. 1 for Application No. 201332311.4, dated Feb. 19, 2016, 3 pages, Australia.
Japan Patent Office, Office Action for Application No. 2015-534808, dated Mar. 1, 2016, 8 pages, Japan.
Korean Intellectual Property Office, Office Action for Application No. 10-2015-7011030, dated Jul. 25, 2016, 9 pages, Republic of Korea.
LTL Home Products, Inc., "Spectrum Folding Doors," Mar. 30, 2009 to Jul. 12, 2012, Internet Archive <http://web.archive.org/web/20090330195345/http://www.ltlhomeproducts.com/oakmont-folding-doors.php>, 1 page.
Servicor Cleanroom Products, "Sliding Track Curtains," Feb. 25, 2002 to Dec. 31, 2008, Internet Archive <http://web.archive.org/web/20080509191632/http://www.servicor.com/slidingcurtain.html>, 1 page.
State Intellectual Property Office of the P.R.C., First Office Action for Application No. 201380060790.6, dated Nov. 1, 2016, 19 pages, China.
United States Patent and Trademark Office, Corrected Notice Allowability for U.S. Appl. No. 14/961,606, dated Jan. 20, 2017, 2 pages, U.S.A.
United States Patent and Trademark Office, Notice of Allowance for U.S. Appl. No. 14/042,612, dated Aug. 4, 2015, 12 pages, U.S.A.
United States Patent and Trademark Office, Notice of Allowance for U.S. Appl. No. 14/961,606, dated Oct. 11, 2016, 7 pages, U.S.A.
United States Patent and Trademark Office, Office Action for U.S. Appl. No. 14/042,612, dated Apr. 16, 2015, 12 pages, U.S.A.
United States Patent and Trademark Office, Office Action for U.S. Appl. No. 14/961,606, dated May 16, 2016, 14 pages, U.S.A.
United States Patent and Trademark Office, Supplemental Notice of Allowability for U.S. Appl. No. 14/961,606, dated Dec. 9, 2016, 3 pages, U.S.A.
Wilson Quality Safety Products, "Accordion Fold Curtains," Feb. 16, 2007 to Feb. 9, 2010, Internet Archive <http://web.archive.org/web/20070216072132/http://www.wilsonindustries.com/partitions-accordion_fold_curtains.htm>, 1 page.
State Intellectual Property Office of the P.R.C., Second Office Action for Application No. 201380060790.6, dated Jun. 7, 2017, 12 pages, China.

* cited by examiner

ITEM DISPENSING APPARATUS

CROSS-REFERENCE TO RELATED APPLICATIONS

This application is a continuation of U.S. application Ser. No. 14/961,606, filed on Dec. 7, 2015, which is a continuation of U.S. application Ser. No. 14/042,612 which was filed on Sep. 30, 2013 and which claims the benefit of U.S. Provisional Application No. 61/707,608, filed Sep. 28, 2012, the entirety of each of these is hereby incorporated by reference.

BACKGROUND OF THE INVENTION

Field of the Invention

Various embodiments of the present invention described herein generally relate to item dispensers, and, in particular, to an access assembly configured for preventing access to one or more items stored within an item dispenser.

Description of Related Art

Item dispensers are frequently used to dispense a variety of items, such as food products, toiletries, and other goods to various users. In the healthcare industry, dispensers are often placed in hospitals and used to distribute linens, surgical scrubs, and other healthcare items to members of a hospital's staff. These dispensers can be configured to store such items on shelves, receptacles, or other item-receiving features disposed within the dispenser, or on moveable carts that can be wheeled into an interior portion of a dispenser. To prevent access to the stored items, the dispensers may include a lockable access door that can be opened by an authorized user.

However, there is an ongoing need in the art for dispensers that enable an authorized user to more easily access stored items. In addition, as energy conservation and efficient use of space are high priorities in various industries, there is a need for dispensers that consume less power during operation and that have a more efficient footprint. Furthermore, in view of increasing efforts to reduce operational cost, there is also a need for dispensers that are more reliable and that can be manufactured at a lower cost.

BRIEF SUMMARY OF THE INVENTION

Various embodiments of the present invention are directed to a dispenser for storing one or more items and providing selective access to the stored items. According to various embodiments, the dispenser comprises a housing defining at least one access opening and at least one interior portion dimensioned for receiving the one or more items; an access assembly operatively connected to the housing and configured for permitting selective user access to the one or more items in the interior portion of the housing; a first flexible barrier extending between the housing and a first side of the door assembly; and a second flexible barrier extending between the housing a second side of the door assembly. In various embodiments, the access assembly comprises a door assembly slidably connected to the housing and configured for lateral movement relative to the housing, the door assembly defining at least one access door adjustable between a locked configuration and an unlocked configuration, wherein the access door provides user access to the interior portion of the housing when in the unlocked configuration.

BRIEF DESCRIPTION OF THE SEVERAL VIEWS OF THE DRAWINGS

Reference will now be made to the accompanying drawings, which are not necessarily drawn to scale, and wherein.

DETAILED DESCRIPTION OF THE INVENTION

Figure 1:
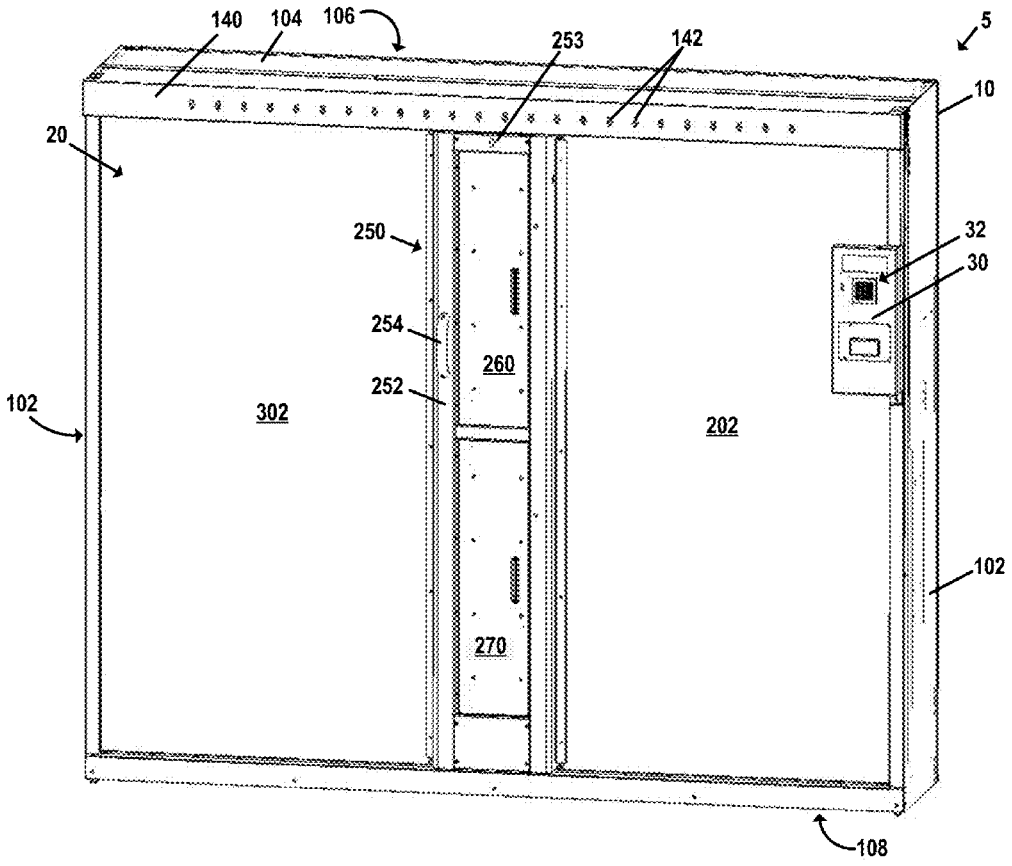
FIG. 1 shows a perspective view of a dispenser having an access assembly configured to selectively provide access to items positioned within the dispenser according to one embodiment of the present invention.

The present invention will now be described more fully hereinafter with reference to the accompanying drawings, in which some, but not all embodiments of the invention are shown. Indeed, the invention may be embodied in many different forms and should not be construed as limited to the embodiments set forth herein. Rather, these embodiments are provided so that this disclosure will satisfy applicable legal requirements. In addition, as used herein, the terms "vertical" and "horizontal" are intended to refer to components oriented generally vertically or generally horizontally. Although such components may be oriented exactly vertically or horizontally with respect to a support surface, the terms vertical and horizontal are not intended to indicate that such an exact orientation is required. Like numbers refer to like elements throughout.

Overview

Various embodiments of the present invention are directed to a dispenser configured for storing one or more items and dispensing the stored items to authorized users. According to various embodiments, the dispenser generally includes a housing defining an interior portion dimensioned to receive a plurality of items. For example, in certain embodiments, the interior portion includes a plurality of receptacles (e.g., cubby holes, divided shelving) each configured for receiving one or more items (e.g., medical scrubs). In order to provide selective access to the items within the dispenser, various embodiments of the dispenser include an access assembly configured to prevent unauthorized user access to the interior portion of the dispenser and provide selective access to certain receptacles in response to input received from an authorized user. According to various embodiments described herein, the access assembly comprises a pair of flexible barriers coupled to a sliding door assembly, which includes one or more lockable access doors. Together, the door assembly and flexible barriers prevent access to the interior of the dispenser when in a locked configuration and permit access to only certain receptacles when in an unlocked configuration.

As described in greater detail herein, various embodiments of the dispenser's access assembly are configured to receive input from a user via a control system (e.g., input generated by swiping an access card or entering an authorization code), which is configured to determine whether the user is authorized to access one or more items in the dispenser. Based on this determination, the control system is further configured to control one or more locking mechanisms on the access assembly in order to provide selective access to only those items a particular user is authorized to access. In other words, the dispenser control access to items therein by preventing unauthorized users from accessing any items and permitting authorized users to access only those items that particular user is authorized to remove from the dispenser. As just one example, the dispenser could be configured to permit access to medical scrubs to only those hospital personnel stationed on the same floor as the dispenser (thereby preventing access to all others, such as patients and other hospital staff).

As will be appreciated from the detailed description below, the various embodiments of the item dispenser described herein enable only authorized users to conveniently remove items from a given dispenser, reduce the overall power consumption of the dispenser, improve the reliability of the dispenser as compared to conventional dispensers, conserve space within the dispenser to provide a large interior space with a reduced footprint, and reduce the overall manufacturing cost of the dispenser.

Item Dispenser

FIG. 1 illustrates a dispenser 5 according to one embodiment. As shown in FIG. 1, the dispenser 5 generally includes a housing 10, an access assembly 20, and a control system 30. As described in greater detail below, housing 10 defines an interior portion configured for storing a plurality of items (e.g., medical scrubs). The access assembly 20 includes a sliding door assembly 250 and a pair of flexible barriers 302, 202, which together selectively prevent access to the interior portion of the housing 10. In particular, the sliding door assembly 250 is configured to slide laterally relative to the housing 10 and selectively permit access to items stored in the interior portion of the housing 10 through a pair of locking access doors 260, 270. As described in detail below, to restrict access to only authorized users and only particular items, the control system 30 is configured to control various aspects of the sliding door assembly 250 based on input received from a user.

Housing & Interior Receptacles

In the illustrated embodiment of FIG. 1, the housing 10 includes a pair of side panels 102, an upper panel 104, a rear panel 106, and a bottom panel 108. According to various embodiments, the panels 102-108 may be formed from any suitable structural material (e.g., metal or high-strength plastics), and may comprise separately connected panels or may be formed from a single piece of shaped structural material.

Figure 2:
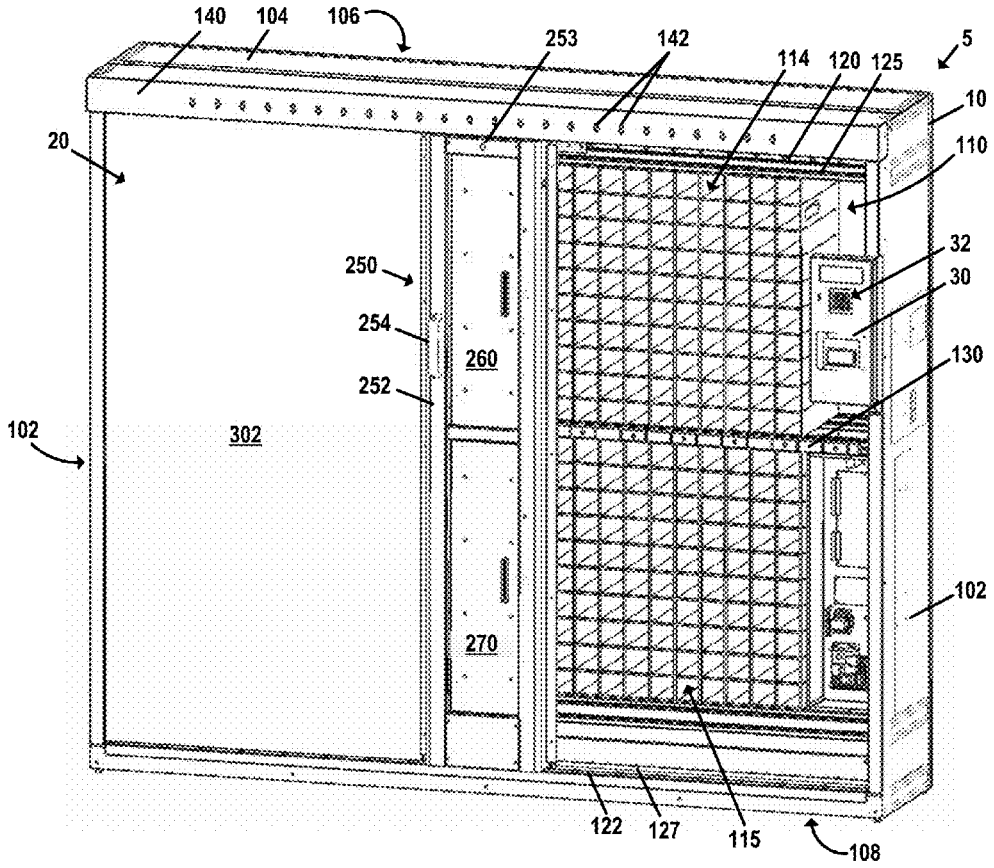
FIG. 2 shows a perspective view of the dispenser of FIG. 1 with a portion of the access assembly removed to reveal an interior portion of the dispenser according to one embodiment of the present invention.

FIG. 2 shows the dispenser 5 with the flexible barrier 202 omitted. As shown in FIG. 2, the housing's panels 102-108 define a front access opening 110 that opens to an interior portion of the housing 10. In the illustrated embodiment, the interior portion of the housing 10 includes a plurality of upper receptacles 114 and lower receptacles 115, which are defined by a plurality of vertical and horizontal dividers. The receptacles 114, 115 are configured to function as item receiving features for storing a plurality of items disposed in the interior portion of the housing 10. For example, in one embodiment configured for application in the healthcare industry, the upper receptacles 114 are dimensioned for storing medical shirt scrubs (e.g., one shirt scrub in each receptacle 114) and the lower receptacles 115 are dimensioned for storing medical pant scrubs (e.g., one pant scrub in each receptacle 115).

As shown in FIG. 2, the receptacles 114, 115 are separated by a central guide member 130, which extends horizontally across the access opening 110 of the housing 10. In the illustrated embodiment, the receptacles 114, 115 are arranged in a grid of columns and rows. Each column of receptacles 114, 115 is aligned with one of a plurality of position indicators 142 provided across an upper indicator panel 140, which extends horizontally across the housing 10 adjacent the upper edge of the housing's access opening 110. In the illustrated embodiment, each position indicator 142 comprises an arrow-shaped light (e.g., an arrow-shaped light illuminated by an LED), the illumination of which is controlled by the control system 30. As explained in greater below, the control system 30 is configured to illuminate one of the position indicators 142 in response to a request from an authorized user for access to one or more items in order to indicate the lateral position to which the user must move the sliding door assembly 250 to access the stored items.

As shown in FIGS. 1 and 2, the housing 10 also includes a first upper horizontal support member comprising an upper horizontal guide rod 120, a second upper horizontal support member comprising an upper guide rail 125, a first lower horizontal support member comprising a lower horizontal guide rod 122, and a second lower horizontal support member comprising a lower horizontal guide rail 127. In the illustrated embodiment of FIG. 2, the upper and lower horizontal guide rods 120, 122 and the upper and lower horizontal guide rails 125, 127 extend across the width of the housing's access opening 110 and are connected to the housing 10 adjacent the access opening's upper perimeter and lower perimeter, respectively.

As will be appreciated from the description herein, the upper and lower horizontal guide rods 120, 122 and the upper and lower horizontal guide rails 125, 127 may comprise separate rod/rail members attached to the housing 10, or may comprise rod/rail members formed from a portion of the housing 10 itself. As described in greater detail below, the guide rods 120, 122 and guide rails 125, 127 facilitate lateral movement of certain portions of the access assembly 20.

Access Assembly

Referring back to FIG. 1, the access assembly 20 is operatively connected to the housing 10 across the housing's access opening 110. As shown in FIG. 1, the access assembly 20 generally comprises a first flexible barrier 202, a second flexible barrier 302, and a sliding door assembly 250. In the illustrated embodiment, the sliding door assembly 250 generally comprises a rigid frame 252, an upper access door 260, and a lower access door 270. According to various embodiments, the sliding door assembly's frame 252 is slidably connected to the housing 10 such that the sliding door assembly 250 is capable of sliding laterally relative to the housing 10. Additionally, the flexible barriers 202, 302—which are secured to opposite sides of the sliding door assembly's frame 252—are slidably connected to the housing 10 such that they can collapse (e.g., by gathering or folding) or expand (e.g., by unfolding) based on the position of the sliding door assembly 250.

Accordingly, as will be appreciated from FIGS. 1 and 2, the sliding door assembly 250, first flexible barrier 202, and second flexible barrier 302 collectively span the access opening 110 and generally prevent access to items disposed within the housing 10 (regardless of the lateral position of the sliding door assembly 250 with respect to the housing 10). However, as explained in greater detail herein, the dispenser's control system 30 is configured to control various aspects of the sliding door assembly 250 in order to provide authorized users with selective access to certain of the receptacles 114, 115 in the housing 10.

According to various embodiments, the flexible barriers 202, 302 may each comprise a fabric sheet made from a tear-resistant material (e.g., ballistic nylon, polyester, Kevlar® fabric). However, as will be appreciated from the description herein, the flexible barriers 202, 302 may be formed from any flexible material of suitable durability and strength.

Figure 3:
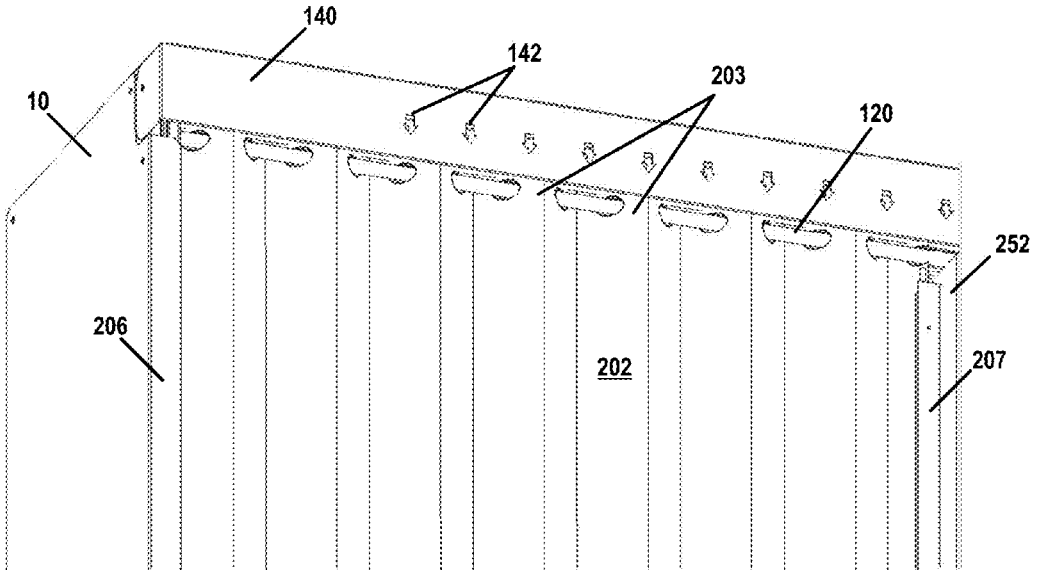
FIG. 3 shows a perspective view of an upper portion of a flexible barrier secured to the dispenser of FIG. 1 according to one embodiment of the present invention.

In the illustrated embodiment of FIGS. 1 and 2, the upper and lower edges of the first flexible barrier 202 are operatively connected to the housing 10 by a first plurality of attachment members comprising a first set of sleeves 203 and a second plurality of attachment members comprising a second set of sleeves 204. As the sleeves 203, 204 are generally obscured from view in FIGS. 1 and 2, FIG. 3 provides a detailed view of the upper edge of the first flexible barrier 202. As shown in FIG. 3, the first set of sleeves 203 are formed from a series of apertures the flexible barrier 202 defined along the flexible barrier's upper edge. In particular, the upper horizontal guide rod 120 extends through the apertures such that the sleeves 203 extend around the upper horizontal guide rod 120. In this way, first flexible barrier 202 is secured to the housing 10 may slide laterally along the upper horizontal guide rod 120.

Figure 4:
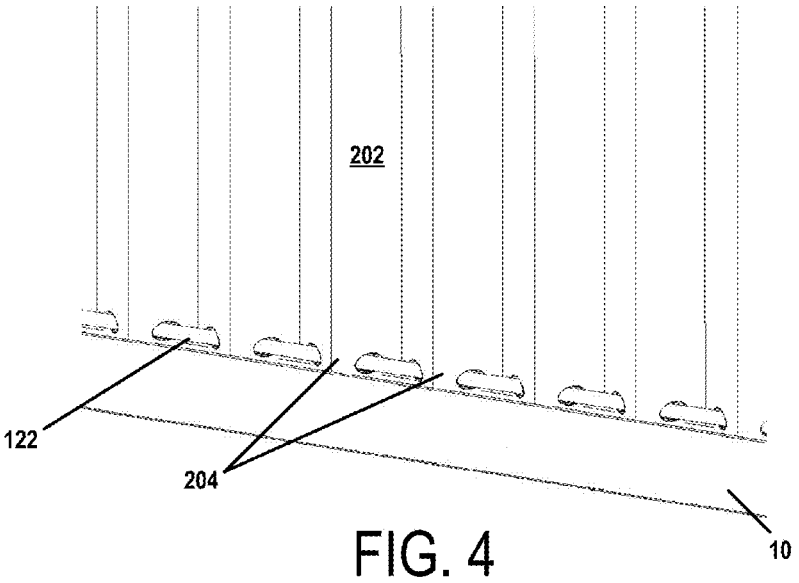
FIG. 4 shows a perspective view of a lower portion of a flexible barrier secured to the dispenser of FIG. 1 according to one embodiment of the present invention.

Similarly, FIG. 4 provides a detailed view of the lower edge of the first flexible barrier 202. As shown in FIG. 4, the second set of sleeves 204 are formed from a series of apertures in the flexible barrier 202 defined along the flexible barrier's lower edge. The lower horizontal guide rod 122 extends through the apertures such that the sleeves 204 extend around the lower horizontal guide rod 122. In this way, the first flexible barrier 202 is further secured to the housing 10 and may slide laterally along the lower horizontal guide rod 122.

As shown in FIG. 1, the first flexible barrier 202 is also attached along its respective side edges to the housing 10 and the sliding door assembly's frame 252. In particular, a first side edge of the first flexible barrier 202 is attached to the housing 10 adjacent a first lateral side of the access opening 110. For example, in the illustrated embodiment of FIG. 3, the first flexible barrier's first side edge is clamped between a C-shaped attachment member 206 secured to the housing 10 along the access opening's first lateral side. However, as will be appreciated from the description herein, the flexible barrier's first side edge can be attached to the housing 10 with various other attachment devices or methods (e.g., using an adhesive or a plurality of fastening devices).

In addition, a second side edge of the first flexible barrier 202 is attached to a side edge of the sliding door assembly's frame 252. For example, in the illustrated embodiment of FIG. 3, the flexible barrier's second side edge is clamped between a C-shaped attachment member 207 secured along a side edge of the sliding door assembly's frame 252. However, as will be appreciated from the description herein, the flexible barrier's second side edge can be attached to the sliding door assembly's frame 252 with various other attachment devices or methods (e.g., using an adhesive or a plurality of fastening devices).

According to various embodiments, the upper, lower, and side edges of the second flexible barrier 302 are operatively connected to the housing 10 and the sliding door assembly 250 in the manner described above in relation to the first flexible barrier 202. Accordingly, the second flexible barrier 302 also includes a first plurality of attachment members comprising a first set of sleeves (secured to the upper horizontal guide rod 120) and a second plurality of attachment members comprising a second set of sleeves (secured to the lower horizontal guide rod 122). The second flexible barrier 302 is also attached along its respective side edges to the housing 10 and the sliding door assembly's frame 252 by C-shaped attachment members (or by other suitable attachment devices or methods).

As noted above, the sliding door assembly 250 generally comprises a rigid frame 252, an upper access door 260, and a lower access door 270. In the illustrated embodiment of FIG. 1, the sliding door assembly's frame 252 is slidably connected to the housing 10 and oriented substantially vertically such that it extends across the full height of the access opening 110. As shown in FIG. 1, the frame 252 has a generally rectangular perimeter and defines openings aligned with the upper and lower access doors 260, 270. In various embodiments, the frame 252 is generally rigid and comprised of a high-strength metal material, such as steel or aluminum. However, as will be appreciated from the description herein, the frame 252 may be comprised of various materials of suitable strength and rigidity.

According to various embodiments, the sliding door assembly's frame 252 is configured to slide laterally relative to the housing 10. For example, in one embodiment, the frame 252 may be slidably connected to the housing 10 at both its upper and lower ends by an upper sliding assembly and a lower sliding assembly configured to slide along the upper and lower guide rails 125, 127. As will be appreciated from the description herein, the upper and lower sliding assemblies permit the sliding door assembly 250 to be laterally moved by a user with respect to the housing 10. For example, in the illustrated embodiment of FIGS. 1 and 2, the frame 252 includes a handle configured to be grasped by a user to manually move the sliding door assembly 250. As described in greater detail below, this allows the sliding door assembly 250 to be moved laterally to a position aligned with a desired column of receptacles 114, 115 such that a user may then access one or more receptacles in the desired column through the access doors 260 and/or 270.

In particular, the sliding door assembly 250 includes an alignment indicator 253 provided at the top end of the sliding door assembly's frame 252. According to various embodiments, the alignment indicator 253 may be—for example—a marking (e.g., a printed arrow) or a light (e.g., an arrow-shaped light illuminated by an LED). As explained below, the alignment indicator 253 is positioned such that when it is aligned with an illuminated one of the position indicators 142 on the housing 10, the sliding door assembly 250 will be properly aligned to provide access to authorized items.

Figure 5:
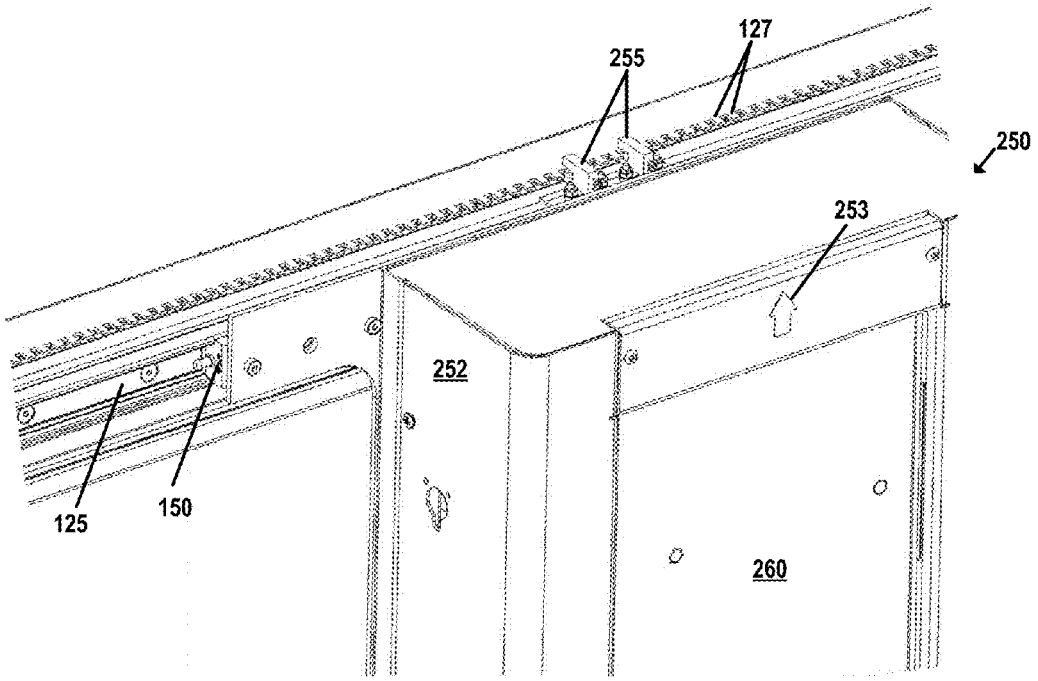
FIG. 5 shows a perspective view of an upper sliding assembly and optical sensors according to one embodiment of the present invention.

In the illustrated embodiment of FIGS. 1 and 2, the sliding door assembly 250 is slidably connected to the housing 10 at both its upper and lower ends by an upper sliding assembly 150 and a lower sliding assembly 160, respectively. FIG. 5 shows an upper portion of the sliding door assembly 250 according to one embodiment. As shown in FIG. 5, the upper portion of the sliding door assembly 250 is operatively connected to the upper sliding assembly 150 (e.g., by a bracket). The upper sliding assembly 150 is configured to slide laterally along the upper guide rail 125. In various embodiments, the upper guide rail 125 is disposed on an interior portion of the housing 10 slightly above the access opening's upper perimeter and extends substantially horizontally across the housing 10 such that it spans the width of the access opening 110.

The upper sliding assembly 150 may, for example, include a bearing block configured to engage the upper guide rail 125 such that the upper sliding assembly 150 can slide smoothly along the upper guide rail 125. In various embodiments, the bearing block and upper guide rail 125 may comprise a commercially available rail and slide unit (e.g., an IKO unit having part number MHTG20C1R1540HS2/T, or an Igus® unit having part numbers WS-10 and WJRM-01-10-LL).

Figure 6:
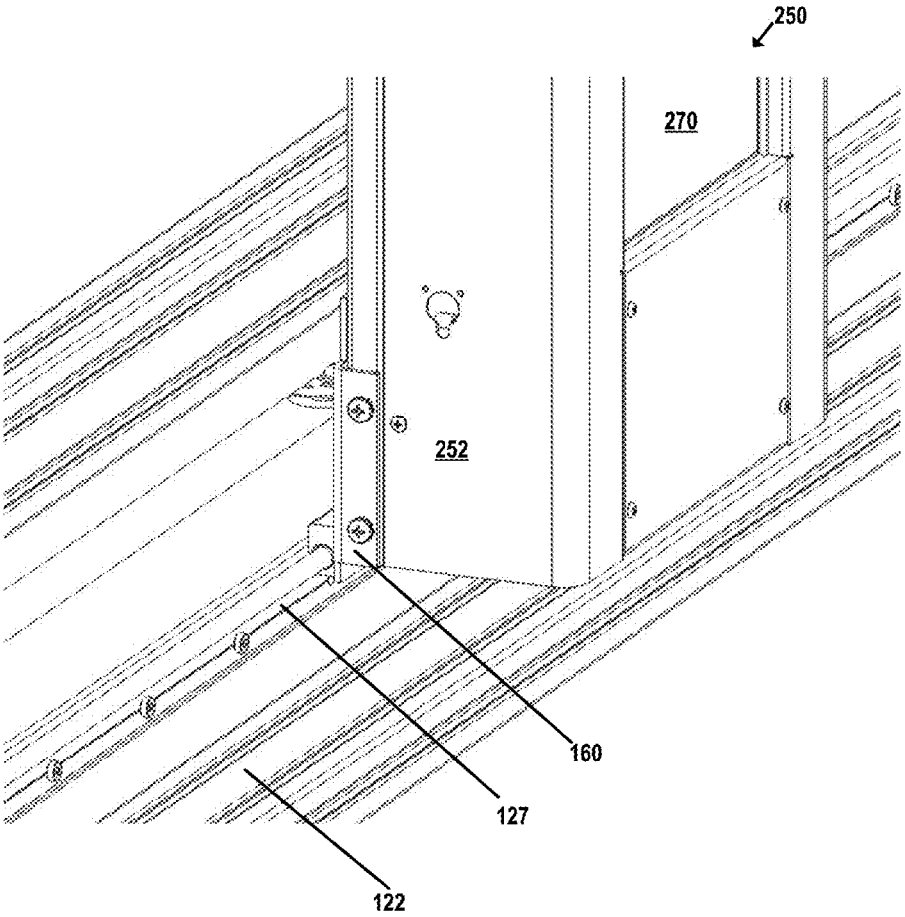
FIG. 6 shows a perspective view of a lower sliding assembly according to one embodiment of the present invention.

FIG. 6 shows a lower portion of the sliding door assembly 250 according to one embodiment. As shown in FIG. 6, the lower portion of the sliding door assembly 250 is operatively connected to a lower sliding assembly 160 (e.g., by a bracket). The lower sliding assembly 160 is configured to slide laterally along the lower guide rail 127. In various embodiments, the lower guide rail 127 is disposed on an interior portion of the housing 10 slightly below the access opening's lower perimeter and extends substantially horizontally across the housing 10 such that it spans the width of the access opening 110. Like the upper sliding assembly 150, the lower sliding assembly 160 may also include a bearing block configured to engage the lower guide rail 127 such that the lower sliding assembly 160 can slide smoothly along the lower guide rail 127. In various embodiments, the bearing block and lower guide rail 127 may comprise a commercially available rail and slide unit (e.g., an Igus® unit having part numbers WS-10 and WJRM-01-10-LL, or an IKO unit having part number MHTG20C1R1540HS2/T). According to various embodiments, the lower sliding assembly and guide rail may comprise a commercially available rail and slide unit, which may be the same as or different from that used for the upper assembly.

Turning back to FIG. 5, the housing 10 also includes a row of teeth 127 disposed just above and adjacent to the upper guide rail 125. To track its movement along the rail 125, the sliding door assembly 250 includes a pair of optical sensors 255 (e.g., optical presence/absence sensors) positioned just above the upper sliding assembly 150. The optical sensors 255 are positioned such that, as the sliding door assembly 250 is moved laterally with respect to the housing 10 (thereby moving the upper sliding assembly 150 along the rail 125), the optical sensors 255 detect the presence and absence of the various teeth 127. As explained in detail below, the optical sensors 255 generate a feedback signal transmitted to the control system 30 that is indicative of the position of the sliding door assembly 250 with respect to the housing 10 and—in particular—the various columns of receptacles 114, 115.

Figure 7:
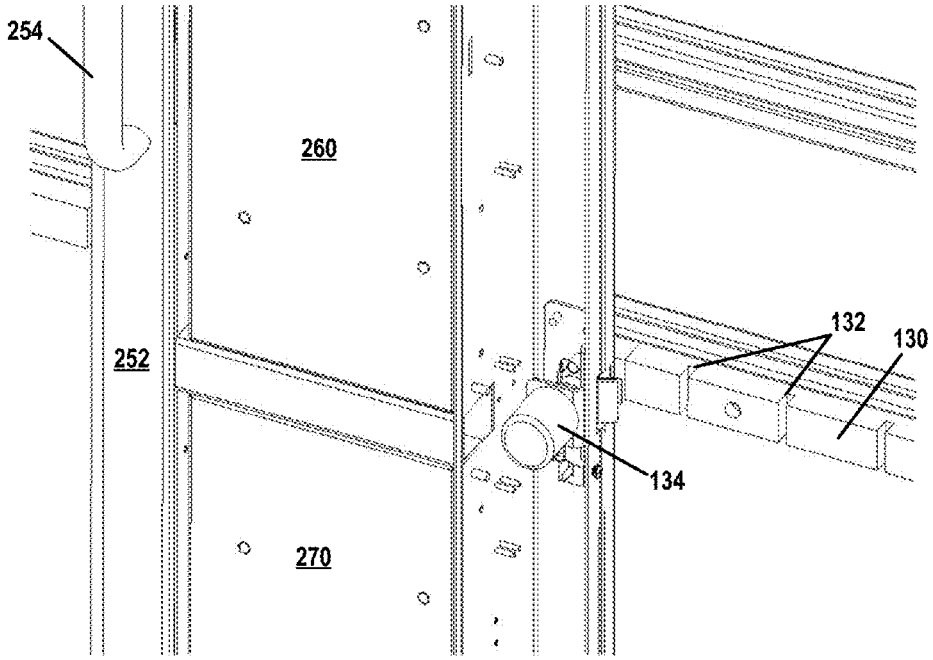
FIG. 7 shows a perspective view of a central guide member and access assembly locking mechanism according to one embodiment of the present invention.

As noted above, various embodiments of the housing 10 also include a central guide member 130, which extends horizontally across the access opening 110 of the housing 10 and generally divides the upper receptacles 114 from the lower receptacles 115. FIG. 7 shows a detailed view of the central guide member 130 and a medial section of the sliding door assembly 250 with a portion of its frame 252 removed. As shown in FIG. 7, the central guide member 130 defines a series of recesses 132 evenly spaced apart from one another. Each of the recesses 132 is generally aligned with a column of the receptacles 114, 115. As such, various embodiments of the central guide member 130 include at least one recess 132 for each column of receptacles 114, 115.

Figure 8:
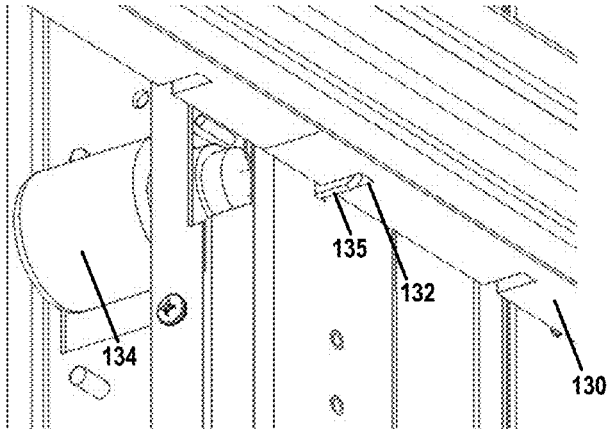
FIG. 8 shows an interior perspective view of an access assembly locking mechanism in a locked configuration with a central guide member according to one embodiment of the present invention.

As shown in FIG. 8, in order to selectively secure the sliding door assembly 250 in a fixed position with respect to the housing 10, the door assembly's frame 252 includes a locking mechanism comprising a solenoid 134 configured to selectively extend a locking member 135 into one of the recesses 132 defined along the central guide member 130. In certain embodiments, the solenoid 134 may be actuated by a user via a handle 254 on the frame 252. In such embodiments, the control system 30 may be configured to prevent actuation of the solenoid 134 such that the sliding door assembly 250 cannot be moved unless the control system 30 detects an authorized user and unlocks the locking mechanism. In other embodiments, the frame 252 may be freely locked and unlocked in place at any time. Additionally, in certain embodiments, the dispenser's control system 30 may be configured to automatically actuate the solenoid 134 and extend its locking member 135 into a recess 132 when the control system 30 determines that sliding assembly 250 has been aligned with the proper column of receptacles 114, 115 (e.g., where the control system 30 determines based on feedback from the optical sensors 255 that the sliding door assembly 250 is aligned with a target column of receptacles corresponding to an illuminated position indicator 142).

As shown in FIG. 1, the sliding door assembly's access doors 260, 270 are generally rectangular and are connected to the frame 252 one on top of the other. In particular, the access doors 260, 270 are positioned adjacent openings in the frame 252 are hingedly connected to the frame 252 such that they can each be independently moved between an open and a closed position. In addition, handles may be defined on the access doors 260, 270. In various embodiments, the sliding door assembly 250 also includes one or more locking mechanisms for selectively locking the access doors 260, 270 (e.g., independently of one another). As described in detail below, these locking mechanisms (e.g., a solenoid or latch) may be actuated by the control system 30 in order to permit only authorized users to move the access doors 260 and/or 270 to an open position.

As will be appreciated from the description herein, when the access doors 260, 270 are locked in a closed position, the sliding door assembly 250—in combination with the flexible barriers 202, 302—prevents unauthorized user access to items disposed within the housing 10 (e.g., in the receptacles 114, 115). However, when the access doors 260, 270 are unlocked and opened, the sliding door assembly 250 provides selective access to certain of the receptacles 114, 115.

Figure 9:
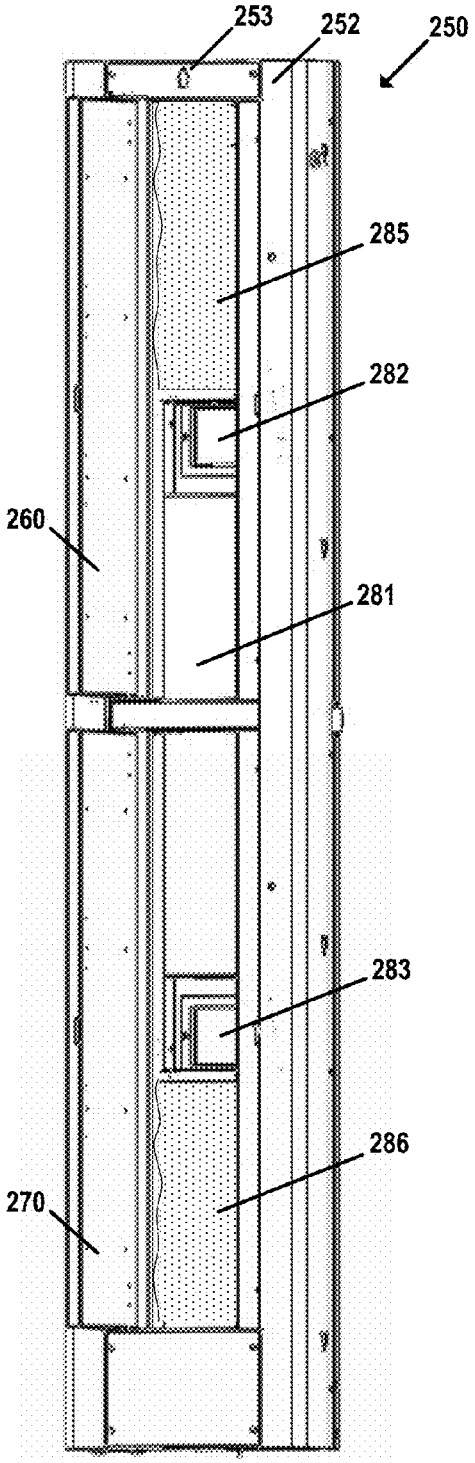
FIG. 9 shows a perspective view of a sliding door assembly according to one embodiment of the present invention.

FIG. 9 shows the sliding door assembly 250 with both of its access doors 260, 270 moved to their unlocked, open positions. As shown in FIG. 9, the sliding door assembly 250 includes a selector mechanism provided behind the access doors 260, 270 that restricts access to only certain receptacles 114, 115. For example, in the illustrated embodiment, the selector mechanism comprises a vertically moveable plate 281 having side edges slidably connected to the frame 252 (e.g., via rails). The plate's upper edge is attached to a flexible upper barrier 285, while the plate's lower edge is attached to a flexible lower barrier 286. As shown in FIG. 9, the side edges of the barriers 285, 286 are slidably attached to the frame 252, while the upper edge of the barrier 285 and lower edge of the barrier 286 are fixedly attached to the frame 252. In addition, the plate 281 defines an upper aperture 282 dimensioned such that a user can access an item disposed within an upper receptacle 114 aligned behind the upper aperture 282, as well as a lower aperture 283 dimensioned such that a user can access an item disposed within a lower receptacle 115 aligned behind the lower aperture 283. Accordingly, as will be appreciated from the embodiment shown in FIG. 9, the plate 281 and barriers 285, 286 prevent access to all but those receptacles 114, 115 aligned behind the apertures 282, 283 when the access doors 260, 270 are opened.

Figure 10:
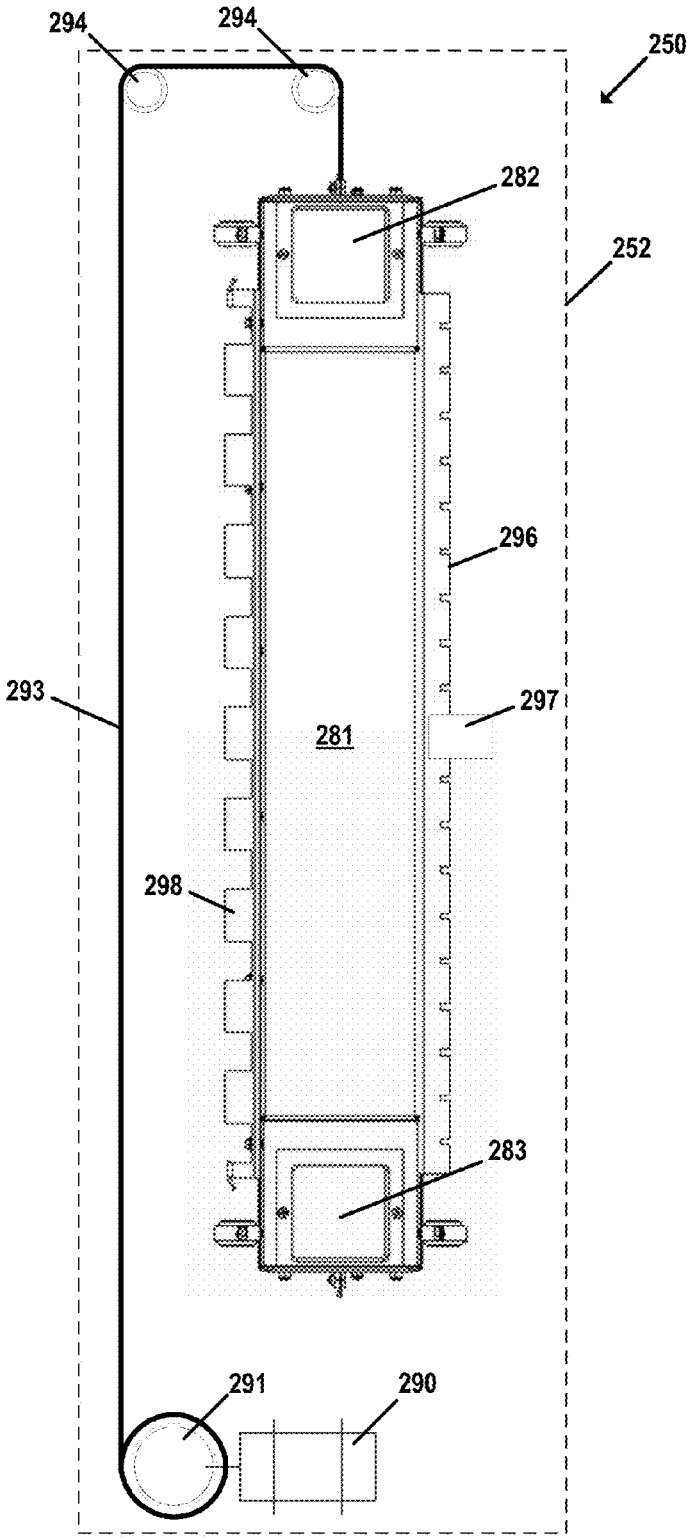
FIG. 10 shows a front view of a selector mechanism and a schematic diagram of a selector mechanism drive system according to one embodiment of the present invention.

FIG. 10 shows the vertically moveable plate 281 along with a schematic diagram of its drive system. In the illustrated embodiment, the plate's drive system includes a motor 290 (e.g., an electric motor) configured to rotate a drive gear 291. A drive belt 293 is secured to the drive gear 291, trained over a pair of upper guide pulleys 294, and connected to the upper end of the plate 281. As a result, the motor 290 can raise or lower the plate 281 with respect to the frame 252 to rotating the drive gear 291.

According to various embodiments, the control system 30 is configured to dictate the operation of the motor 290. As shown in FIG. 10, the slide plate 281 includes a first row of teeth 296 along its right side edge. The drive system includes an optical sensor 297 (e.g., an optical presence/absence sensor) positioned adjacent the first row of teeth 296 and configured to generate a signal indicative of the teeth's movement past the sensor 297. Based on the feedback from the optical sensor 297, the control system 30 is able to determine the vertical position of the slide plate 281 and thereby move the plate 281 to a desired vertical position relative to the frame 252 and receptacles 114, 115.

By moving the plate 281 vertically along the frame 252, the control system 30 is able to dictate which of the receptacles 114, 115 a user may have access to. For example, in the illustrated embodiment, the plate 281 is configured such that only one of the upper receptacles 114 will be positioned behind the upper aperture 282 and only one of the lower receptacles 115 will be positioned behind the lower aperture 283 at any given time. As a result, the lateral position of the sliding door assembly 250 and the vertical position of the plate 281 dictates which two receptacles 114, 115 an authorized user may have access to in a given instance.

Figure 11:
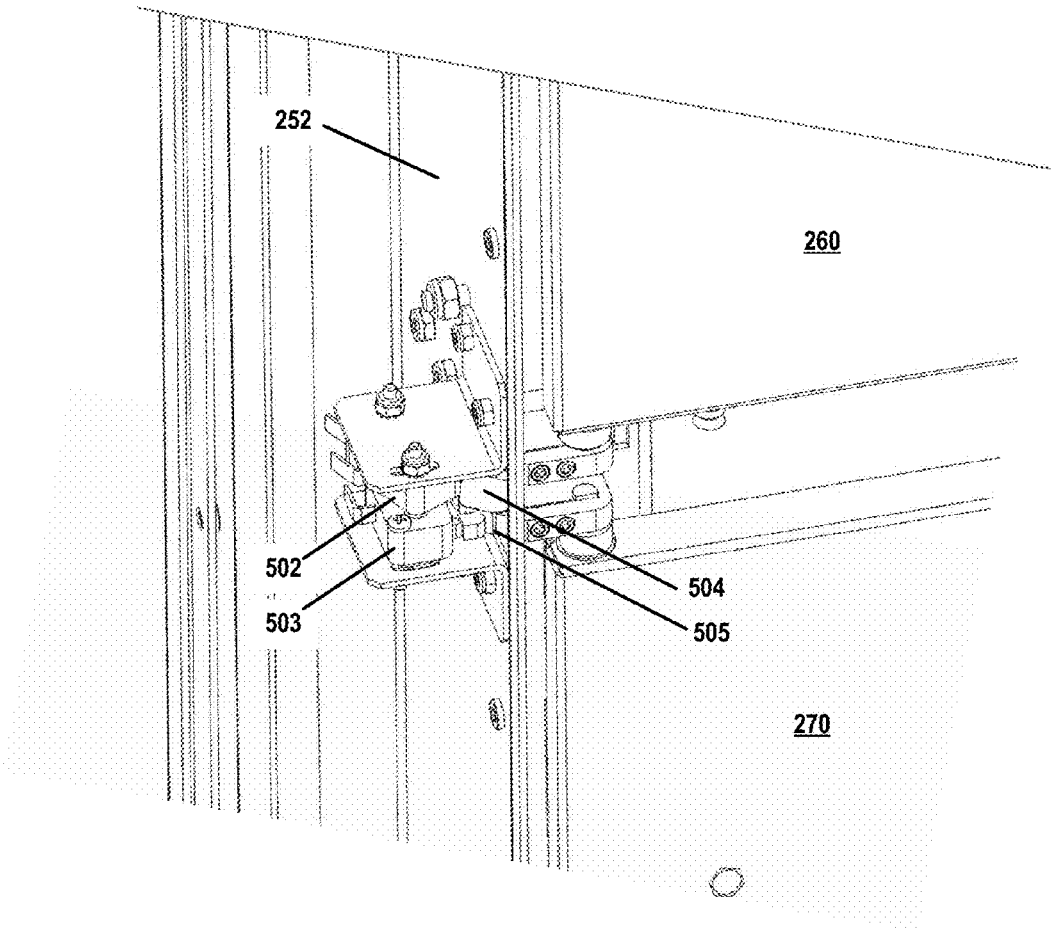
FIG. 11 shows a perspective view of positions sensors and associated access doors according to one embodiment of the present invention.

In order to provide accurate feedback to the control system 30 as to the state of the access doors 260, 270, each access door includes a position sensor and locking sensor. For example, FIG. 11 shows the lower portion of the upper access door 260 and the upper portion of the lower access door 270. As shown in FIG. 11, the upper access door 260 is operatively connected to a first cam 504 which engages a first position sensor 502 when the upper access door 260 is in its fully closed position. This causes the first position sensor 502 to generate a signal indicating to the control system 30 that the upper access door 260 is closed. However, when the upper access door 260 is rotated open, the first cam 504 also rotates and disengages the position sensor 502, thereby indicating to the control system 30 that the upper access door 260 is open. Likewise, the lower access door 270 is operatively connected to a second cam 505 configured to engage a second position sensor 503; the second cam 505 and second position sensor 503 being configured to operate in the same way in order to provide a feedback signal to the control system 30 indicating whether the lower access door 270 is fully closed.

A portion of the cams 504, 505 are also configured to protrude toward the slide plate 281 when their respective access doors 260, 270 are in their open position. Referring back to FIG. 10, the slide plate 281 includes a second row of teeth 298 along its left side edge. The teeth 298 are dimensioned such that the protruding portion of the cams 504, 505 will extend between two of the teeth 298 when the slide plate 281 is at one of its predefined vertical positions and the corresponding access door 260, 270 is opened. This serves as a redundant lock to ensure the vertical position of the plate 281 does not change when either of the access doors 260, 270 are opened.

Figure 12:
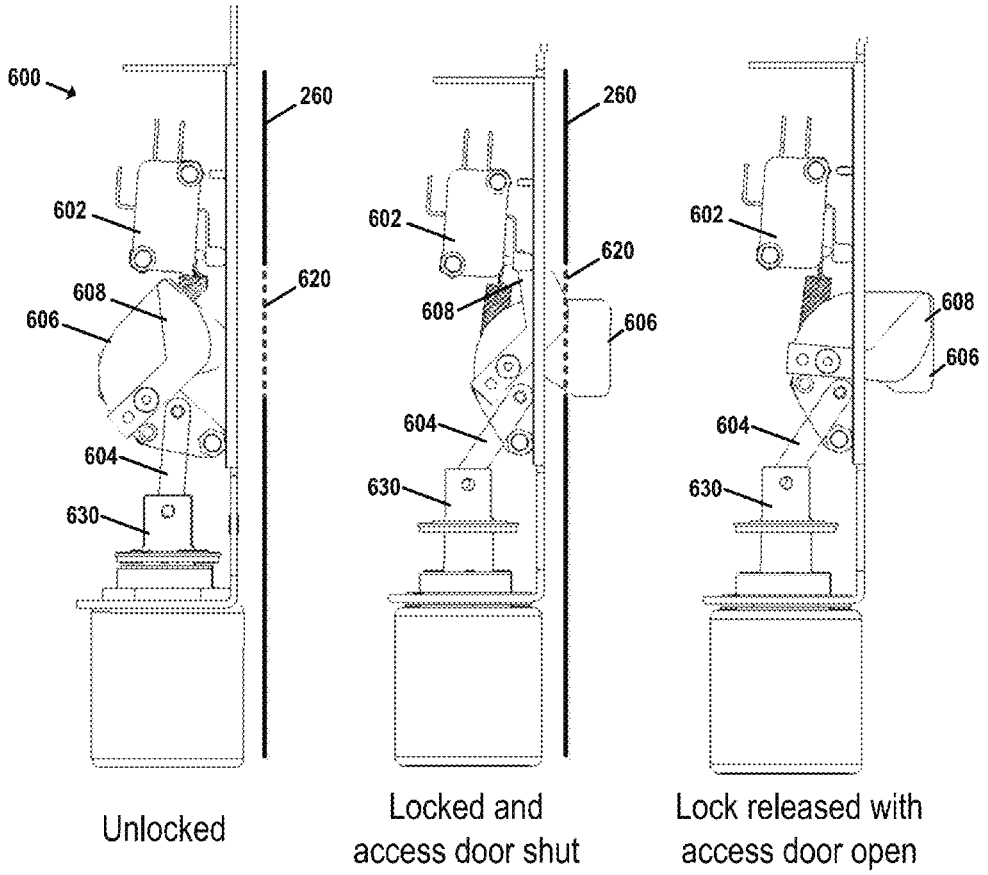
FIG. 12 shows an access door locking mechanism in unlocked, locked, and released configurations according to one embodiment of the present invention.

FIG. 12 shows the upper access door's locking mechanism 600 and locking sensor 602, which are disposed within the sliding door assembly's frame 252 adjacent its side edge. In the illustrated embodiment, the locking mechanism 600 comprises an actuation member 604, a latch member 606, and an engagement member 608. As shown in FIG. 12, the latch member 606 and engagement member 608 are pivotably connected to the actuation member 604.

The actuation member 604 is moved vertically by a solenoid 630 controlled by the control system 30. When the solenoid 630 is activated, the actuation member 604 is raised to an upper position and, as a result, the latch member 606 and engagement member 608 protrude from an opening 620 in the side edge of the frame. As shown in FIG. 12, if the access door 260 is fully closed, the latch member 606 will engage an aperture in the access door 260 while the engagement member 608 will be pushed by the edge of the access door 260 into the locking sensor 602. In this way, the latch member 606 secures the access door 260 in a closed position while the contact between engagement member 608 and locking sensor 602 generates a control signal to the control system 30 indicating the access door 260 is properly closed and locked. If the access door 260 is not fully closed, both the latch member 606 and engagement member 608 will protrude from the opening 620 when the solenoid 630 is activated, the engagement member 608 will not contact the access door 260 and be pushed into the sensor 602, and no signal will be generated from the locking sensor 602 (thereby indicating the access door 260 is not properly closed and locked).

When the solenoid 630 is deactivated, the actuation member 604 is in a lower position and, as a result, the latch member 606 and engagement member 608 are retracted from the opening 620 in the side edge of the frame 252. In this position, the locking mechanism 600 is unlocked, enabling the upper access door 260 to be freely opened and closed. In various embodiments, an identical locking mechanism and locking sensor are used for the lower access door 270.

Control System & User Operation

According to various embodiments, the control system 30 comprises a computing device (e.g., one or more processors and one or more memory storage devices) configured to interface with one or more user input devices disposed on the exterior of the housing (e.g., a keypad, a card reader, and/or an RFID reader). For example, in the illustrated embodiment of FIGS. 1 and 2, the control system 30 is contained in a small housing attached to one of the dispenser side walls 102 and includes a user interface 32 comprising a keypad, a card reader, and a display screen. As described in greater detail below, the control system 30 is generally configured to (i) determine whether input received via the user interface 32 indicates that a user is authorized to access certain items in the dispenser 5, (ii) determine the particular receptacle(s) 114, 115 the user is authorized to access, (iii) actuate one or more locking mechanism and selector mechanisms to permit user access to the identified receptacles 114, 115, and (iv) monitor the presence and absence of items in the receptacles 114, 115 based on user access to the dispenser 5. The following provides a summary of exemplary steps executed by the control system 30 and an authorized user to access items in the dispenser 5.

The process begins when a user approaches the dispenser 5 in the configuration shown in FIG. 1. As will be appreciated from the description herein, when the dispenser 5 is in the configuration of FIG. 1, the access assembly 20 prevents a user from accessing any of the items stored in interior of the dispenser's housing 10. Next, a user provides user-identifying input to the control system 30 via the user interface 32 (e.g., by swiping an access card or manually entering an employee ID code). The control system 30 then determines whether the user input received is associated with a user authorized to access items in the dispenser 5. In various embodiments, the control system 30 may be pre-programmed with a list of authorized user codes, or may be configured to communicate with a remote server or other computer system to determine whether the received user input is associated with an authorized user.

If the received user input is not associated with an authorized user, the control system 30 indicates that the user is not authorized to access items therein and maintains the configuration of FIG. 1 by not actuating any of the above-described locking mechanisms. If the received user input is associated with an authorized user, the control system 30 next determines which receptacles 114, 115 the user should be provided access to. For example, in one embodiment, the control system 30 identifies a pair of authorized receptacles 114, 115 containing authorized items (e.g., receptacles from which items have not been removed and unfilled) based on updated item availability data for the dispenser 5. According to various embodiments, the item available data may be stored locally (e.g., on the control system's memory devices) or may be stored remotely (e.g., on a server in communication with the control system 30). In various embodiments, the item availability data may comprise data indicating whether each receptacle in the dispenser 5 is filled or empty (e.g., by defining each receptacle by row and column and storing data indicative of filled or empty). In various embodiments, the item availability data may further comprise data indicating the type, size, or other attributes of the items stored in each receptacle.

According to various embodiments, the authorized items may be, for example, an authorized scrub shirt disposed in the first authorized receptacle 114 and an authorized scrub pant disposed in the second authorized receptacle 115. In certain embodiments, the control system 30 may be further configured to ensure the accessed receptacles 114, 115 contain scrubs that are the same size (e.g., a medium size shirt and medium size pant).

Based on the position of the authorized receptacles 114, 115 (e.g., the column and row of each), the control system 30 next executes a series of locking mechanism actuation steps to provide user access to the authorized items. First, the control system 30 enables the sliding door assembly's frame locking mechanism to be actuated by a user such that the frame 252 can be moved laterally along the housing 10. For example, in one embodiment, the control system 30 enables a user to disengage the solenoid 134 from a recess 132 in the central guide member 130 (e.g., by pulling a handle). In other embodiments, the control system 30 automatically disengages the solenoid 134.

Next, the control system 30 provides an indication as to the desired position of the sliding door assembly 250 in order to access the authorized items. For example, in one embodiment, the control system 30 illuminates the position indicator 142 aligned with the column of receptacles 114, 115 to which the user will be permitted access. Next, the user unlocks the sliding door assembly 250 from its fixed position relative to the housing (e.g., by squeezing or pulling a handle on the frame 252 and unlocking the frame's locking mechanism) and manually slides the sliding door assembly 250 to a lateral position in which the sliding door assembly's alignment indicator 253 is aligned with the illuminated position indicator 142. Once the sliding door assembly 250 is in the target position, the user relocks the sliding door assembly 250 to fix its lateral position (e.g., by releasing or squeezing the handle). In other embodiments, the control system 30 automatically reengages the solenoid 134. Indeed, according to various embodiments, the locking mechanism that locks the sliding door assembly's frame 252 to the housing 10 may be entirely manually actuated, entirely actuated by the control system 30, or actuated by a combination of manual and automated action.

Next, the control system 30 detects whether the sliding door assembly 250 has been moved to the proper lateral position on the housing 10 and is locked in the proper lateral position. For example, in one embodiment, the control system 30 detects the lateral position of the sliding door assembly based on feedback from the optical sensors 255. In such embodiments, the control system 30 may require the position of the sliding door assembly 250 to be calibrated when the dispenser 5 is first turned on (e.g., by requesting the user to move the sliding door assembly 250 to its central lateral position). Thereafter, the feedback generated by the interaction of the optical sensors 255 with the teeth 127 indicates the lateral position of the sliding door assembly 250 relative to the calibrated position (e.g., the center of the housing 10). For example, in one embodiment, the control system 30 is configured to correlate the patterns of "1"s and "0"s generated by the optical sensors 255 to the direction from center and distance from center the lateral sliding door 250 has been moved, and check that determination against the target lateral position corresponding to the illuminated position indicator 142. In various embodiments, the control system 30 may be further configured to confirm the solenoid 134 is engaged and the sliding door assembly 250 is relocked into position before allowing the user to proceed with access.

When the control system 30 determines that the sliding door assembly 250 is locked in the appropriate lateral position, the control system 30 then moves the upper aperture 282 of the plate 281 into alignment with the first authorized receptacle 114 (e.g., by powering the plate's motor 290). The control system 30 then actuates the locking mechanism 600's solenoid 630 to unlock the upper access door 260 and provide user access to the first authorized receptacle 114.

Next, the control system 30 waits for the user to remove the first authorized item from the first authorized receptacle 114 and close the upper access door 260. When the control system 30 senses that the upper access door 260 has been closed (e.g., based on feedback from the position sensor 502), the control system 30 relocks the upper access door 260 by deactivating the solenoid 630. The control system then confirms the access door 260 is properly closed and locked based on feedback from the locking sensor 620.

The above-described process is then repeated for the lower access door 270 in order to provide user access to the second authorized item in the second authorized receptacle 115 (if any). In some instances, this may involve simply unlocking the lower access door 270 where the lower aperture 283 of the plate 281 is already aligned with the target lower receptacle 115. In other instances, the control system 30 may be required to move the plate 281 such that the lower aperture 283 is aligned with the target receptacle. Additionally, if the authorized receptacles are in different rows, the control system 30 may require the user to again move the sliding door assembly 250 before accessing the second authorized item. However, in certain embodiments, the control system 30 may be configured to minimize the actions required and provide access to pairs of items stored in receptacles in the same row.

Finally, after the authorized user has accessed and removed the first and second authorized items from the first and second authorized receptacles 114, 115, the control system 30 confirms that the access doors 260, 270 are both in a closed locked position and the sliding door assembly 250 is locked in a fixed lateral position. In this way, the dispenser 5 prevents further access to items in the dispenser until an authorized user makes another request.

Additionally, the control system 30 updates item availability data for the dispenser 5 to reflect that the first and second authorized receptacles 114, 115 are no longer filled. According to various embodiments, however, the dispenser's control system 30 may be adapted to provide various other functionalities. As an example, in certain embodiments, the dispenser 5 may include a scale configured to monitor the weight of items stored in the interior portion of the housing 10 (e.g., the total weight of all items stored in the receptacles 114, 115). In addition, the dispenser 5 may include a plurality of sensors in the receptacles 114, 115 (e.g., optical or RFID sensors) configured to directly monitor the presence or absence of items in each of the receptacles 114, 115. In certain embodiments, the control system 30 may also be connected over a network to a remote inventory management server configured to monitor item levels in various dispensers and notify an operating entity (e.g., a hospital) when certain dispensers need to be refilled.

As will be appreciated from the description herein, certain embodiments of the dispenser 5 do not require a motor to power the movement of the sliding door assembly 250 along the housing 10. In such embodiments, the overall energy consumption and power efficiency of the dispenser 5 is improved due to the lack of such a motor. In addition, the overall reliability of the dispenser 5 is high and manufacturing cost of the dispenser 5 is low due to the simple, reliable components comprising the dispenser 5. Moreover, the dispenser's compact design provides a high interior-capacity-to-footprint ratio. Furthermore, the aforementioned components of the access assembly 20 enable an authorized user to easily move and open the sliding door assembly 250. In addition, the flexible barriers 202, 302 and sliding door assembly 250 enable the access assembly 20 to be of relatively light weight, further reducing the effort necessary from an authorized user. Moreover, the laterally sliding nature of the access assembly 20 enables authorized users to access items from a comfortable position.

Alternative Dispenser Embodiments

As will be appreciated from the description provided herein, various modifications to the dispenser 5 may be made within the scope of the present invention. For example, in relation to the housing 10, various embodiments of the upper and lower receptacles 114, 115 may have the same or different dimensions based on the intended application of the dispenser 5. In addition, according to various other embodiments, a plurality of different sized receptacles may be provided (e.g., quadrants of unique receptacle sets or individually unique receptacles adapted for receiving and storing specific items). Moreover, the receptacles 114, 115 may be dimensioned to receive any type of item for dispensing from the dispenser 5 (e.g., linens, scrubs, medical supplies, etc.). Additionally, various other item support features may be provided in the interior portion of the housing 10 in addition to, or in place of, the receptacles 114, 115. For example, in certain embodiments, divided shelves or slots dimensioned for receiving items may be disposed in the interior portion of the housing 10.

Figure 13:
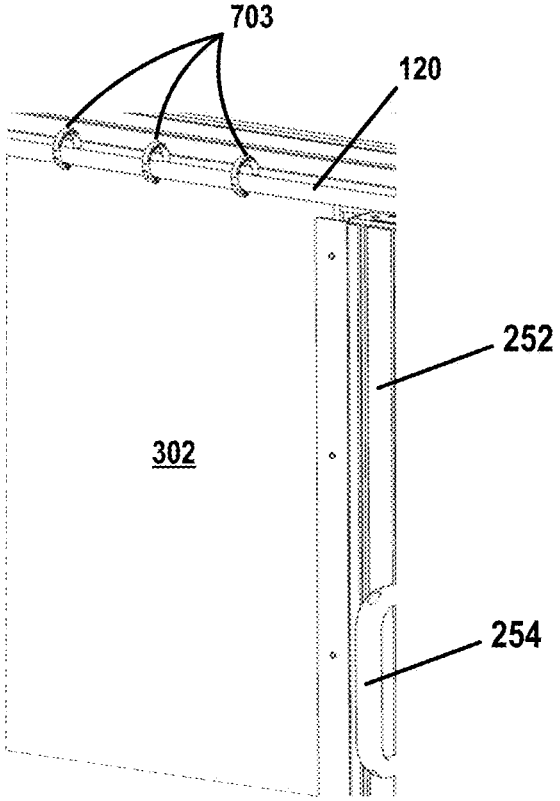
FIG. 13 shows a perspective view of an upper portion of a flexible barrier secured to a dispenser housing according to another embodiment of the present invention.

In relation to the access assembly, the flexible barriers 202, 302 may be secured to the housing 10 using any suitable attachment members or methods. For example, FIG. 13 illustrates one embodiment in which the second flexible barrier 302 is slidably connected to the upper horizontal guide rod 120 by a plurality of rings 703. As shown in FIG. 13, each of the rings 703 extends around the upper horizontal guide rod 120 such that the barrier 302 may slide laterally along the upper horizontal guide rod 120. In such an embodiment, each of the rings 703 may extend through a hole in the flexible barrier 302 such that, together, the rings 703 operatively connect the upper edge of the flexible barrier 302 to the upper horizontal guide rod 120. Rings of this type may also be used to secure the bottom of the barrier 302, as well as the top and bottom edges of the first flexible barrier 202.

In other embodiments, the guide rods 120, 122 may be replaced with additional guide rails and the flexible barriers 202, 302 may be operatively connected to the additional guide rails by a plurality of bearing blocks or other slideable mechanisms. In addition, the sliding door assembly's frame 252 may also be operatively connected to the housing 10 using a variety of methods. For example, in certain embodiments, the upper and lower ends of the frame 252 may be configured to slide along the upper and lower guide rods 120, 122. Additionally, in order to selectively secure the sliding door assembly 250 in a fixed position with respect to the housing 10, any suitable locking mechanism configured to engage a portion of the housing 10 may be used (e.g., one or more latches, solenoids, magnets, etc.).

In further embodiments, a powered motor may be provided to automatically move the sliding door assembly 250 along the housing 10. In such embodiments, the low-friction, light weight, access assembly design of FIGS. 1-12 may be incorporated such that a relatively low power motor may be used. In this case, power consumption, reliability, manufacturing cost, and footprint efficiency are still improved over prior designs.

Figure 14:
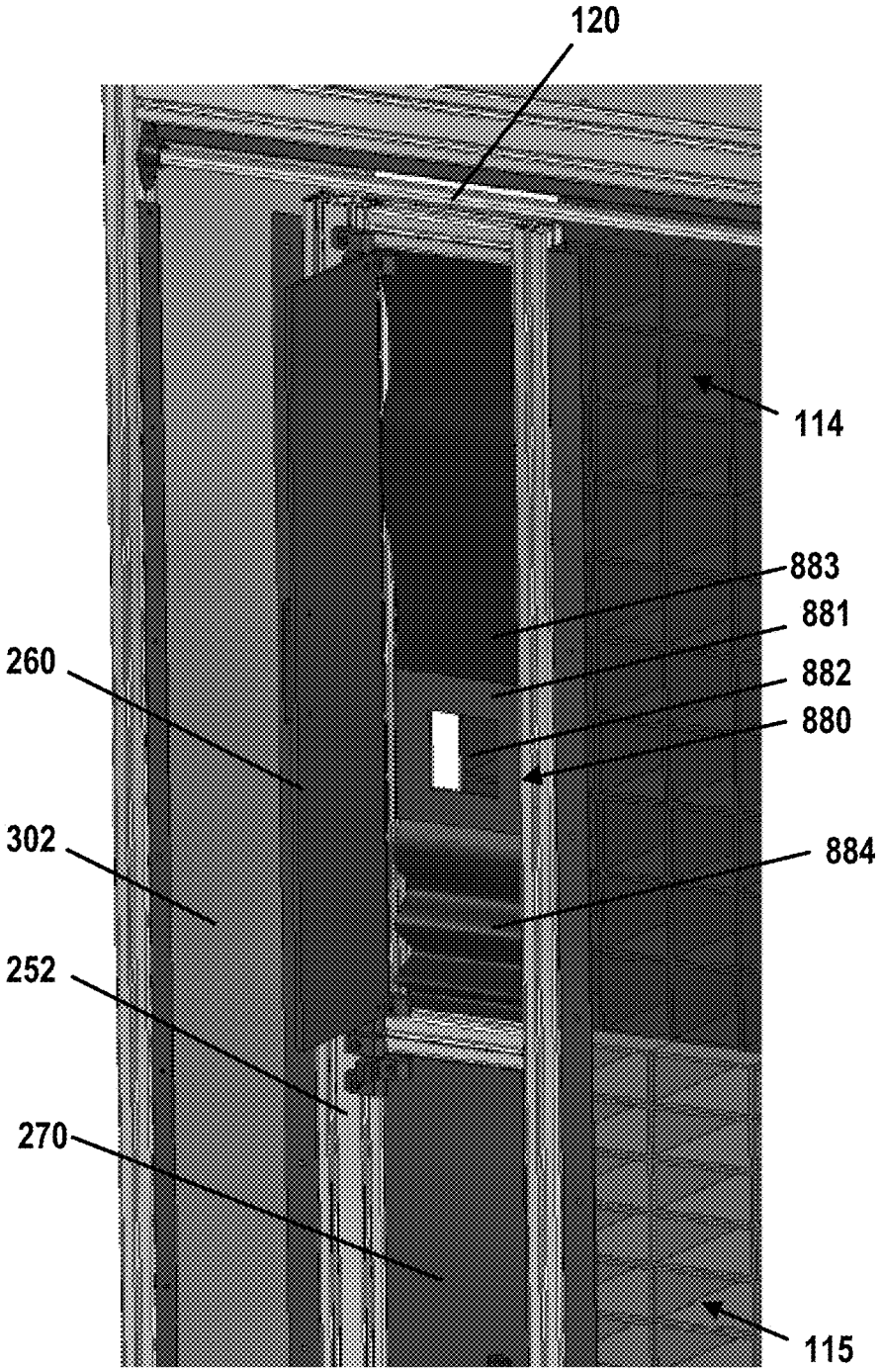
FIG. 14 shows a perspective view of an upper portion of a sliding door assembly according to another embodiment of the present invention.

In certain embodiments, the sliding door assembly 250 may also separate upper and lower selector mechanisms for providing access to the receptacles 114, 115 through the access doors 260, 270. For example, FIG. 14 illustrates an alternative selector mechanism 880 provided behind the upper access door 260 according to one embodiment. In the illustrated embodiment, the selector mechanism 880 comprises a vertically moveable plate 881 having side edges operatively connected to the frame 252. In certain embodiments, the plate 881 may be operatively connected to a motor (e.g., a linear rack and pinion motor assembly or other drive mechanism) controlled by the control system 30 and configured to automatically move vertically along the frame 252. As will be appreciated from FIG. 14, the plate 881 is positioned behind the upper access door 260 and may be configured to move to a desired vertical position while the access door 260 remains locked and closed.

In the illustrated embodiment, the plate's upper edge is attached to a flexible upper barrier 883, while the plate's lower edge is attached to a flexible lower barrier 884. The side edges of the barriers 883, 884 are slidably attached to the frame 252, while the upper edge of the barrier 883 and lower edge of the barrier 884 are fixedly attached to the frame 252. In addition, the plate 881 defines a central aperture 882 dimensioned such that a user can access an item disposed within a receptacle 114 aligned with the aperture 882. Accordingly, as will be appreciated from the embodiment shown in FIG. 14, the plate 881 and barriers 883, 884 prevent access to all but an aligned one of the receptacles 114 when the access door 260 is opened. By moving the plate 281 vertically along the frame, the control system 30 is able to dictate which of the receptacles 114, 115 positioned behind the door 260 a user may have access to. In such an embodiment, an identical selector mechanism 880 may be provided behind the lower access door 270 and independently controlled by the control system 30.

Figure 15:
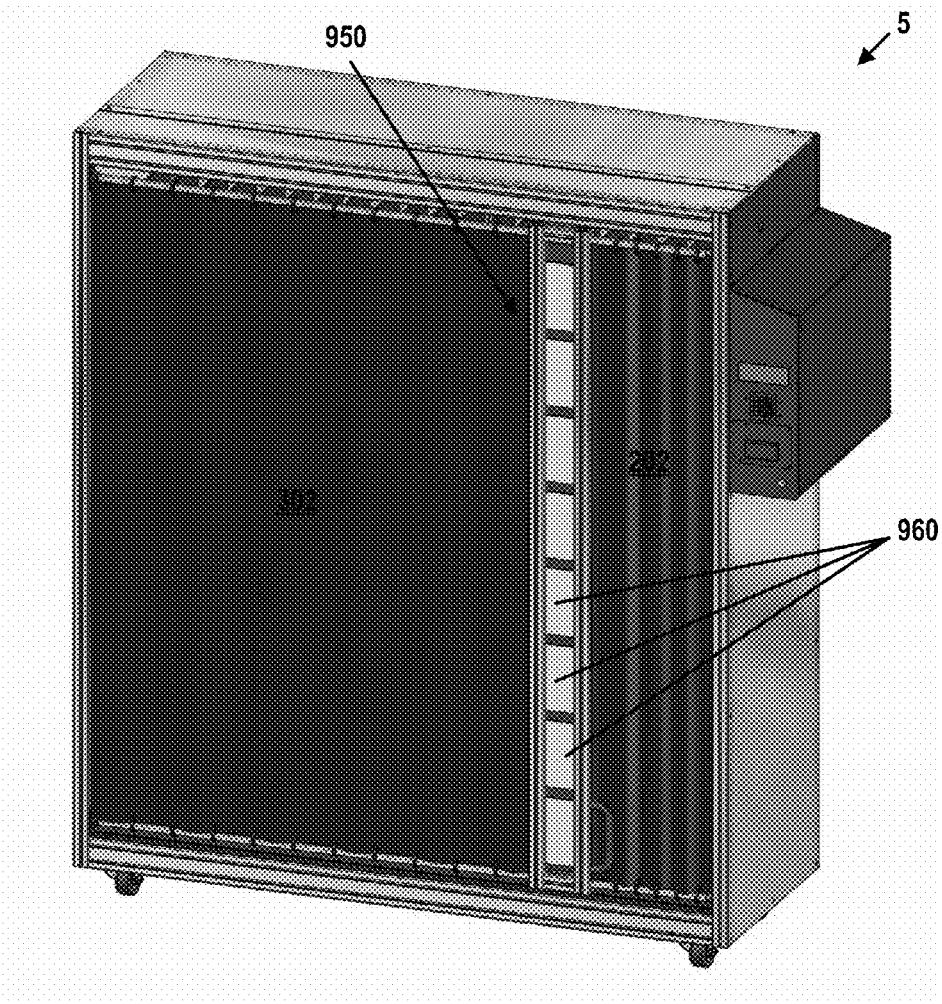
FIG. 15 shows a perspective view of a dispenser having an access assembly configured to selectively provide access to items positioned within the dispenser according to another embodiment of the present invention.
Figure 16:
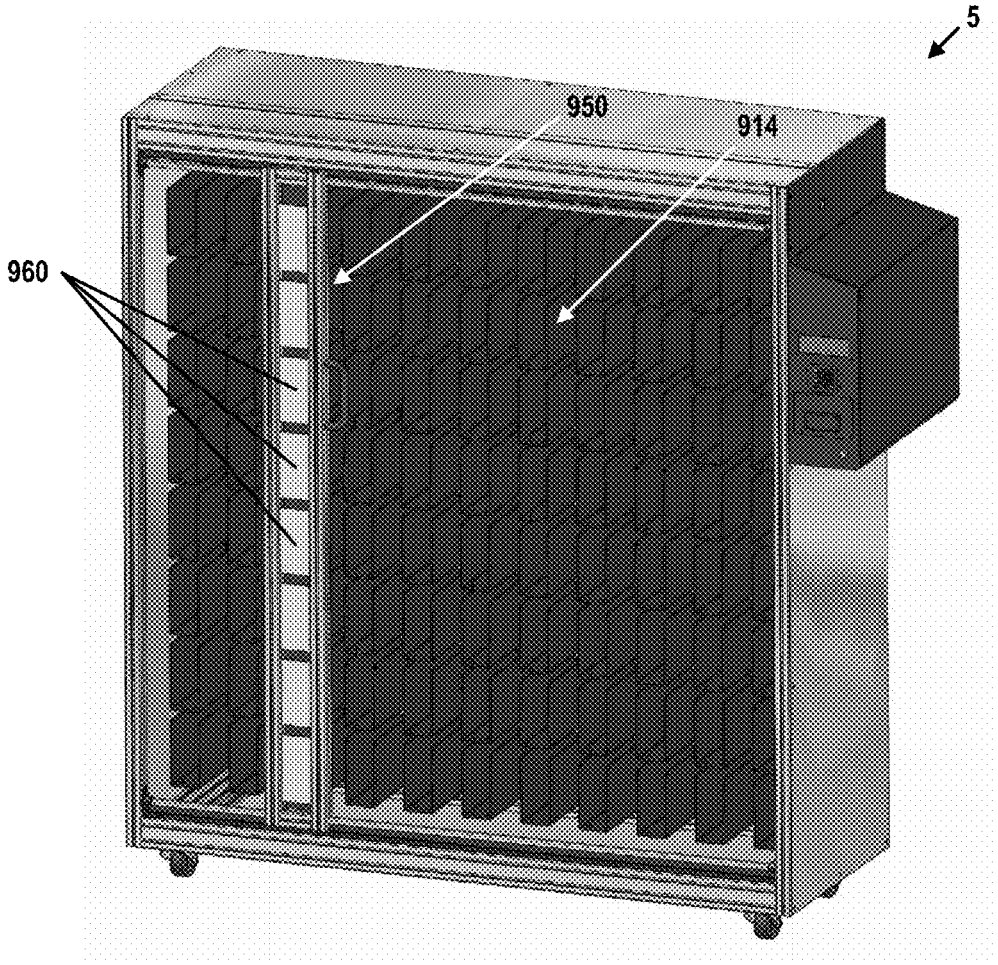
FIG. 16 shows a perspective view of the dispenser of FIG. 15 with a portion of the access assembly removed to reveal an interior portion of the dispenser according to one embodiment of the present invention.

In addition, the design of the access doors 260, 270 on the sliding door assembly 250 may be modified as well. For example, FIG. 15 illustrates another embodiment of the dispenser 5 in which a sliding door assembly 950 having a plurality of lockable access doors 960 is provided. As shown in FIG. 16, the interior portion of the dispenser 5 includes a plurality of receptacles 914 arranged in rows each aligned with one of the access doors 960. As such, in the illustrated embodiment of FIGS. 15-16, a similar process can be executed by the control system 30 and an authorized user to access authorized items, but without the need for the selector mechanism. For example, when the sliding door assembly 950 is in the proper lateral position, the control system 30 may be configured to unlock an access door 960 aligned with a targeted receptacle 914 to provide access to the targeted receptacle 914 only. In such embodiments, indicator lights may also be provided on the sliding door assembly 950 adjacent the access doors 960 to indicate an unlocked and accessible door to an authorized user.

CONCLUSION

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A dispenser for storing a plurality of items and providing selective access to the stored items, the dispenser comprising:

a housing defining at least one access opening and at least one interior portion defining:

a plurality of item receptacles configured for storing one or more items, wherein the plurality of item receptacles are arranged in a grid defining item receptacle rows and item receptacle columns; and a plurality of door locking features each corresponding to at least one item receptacle column; and an access assembly comprising a door assembly laterally moveable across the access opening and configured for permitting selective access to items disposed in the plurality of item receptacles, the door assembly comprising a locking mechanism configured to selectably engage at least one of the plurality of locking features such that the door assembly is configurable between:

a movable configuration in which the door assembly is free to move laterally across the access opening; and an immobile configuration in which the door assembly is locked in alignment with at least one of the item receptacle columns to permit user access to at least one item receptacle within the aligned item receptacle columns; and wherein the door assembly further comprises at least one access door operatively connected to the door assembly and adjustable between a locked configuration and an unlocked configuration, and wherein the access door permits access to at least one item receptacle through the door assembly when in the unlocked configuration and prevents access to the item receptacles when in the locked configuration.

2. The dispenser of claim 1, wherein the housing comprises a plurality of position indicators each corresponding to one or more of the item receptacle columns; and the door assembly comprises an alignment indicator positioned such that the alignment indicator is aligned with one of the plurality of position indicators when the door assembly is aligned with one or more of the item receptacle columns.

3. The dispenser of claim 2, wherein the plurality of position indicators comprise a plurality of lights.

4. The dispenser of claim 2, further comprising a control system comprising one or more processors and at least one user input device, wherein the control system is configured to:

receive user input requesting access to at least one item receptacle; and illuminate at least one position indicator corresponding to an item receptacle column containing the at least one item receptacle to be accessed by the user.

5. The dispenser of claim 4, wherein the control system is further configured to detect when the door assembly is aligned with the item receptacle column containing the at least one item receptacle to be accessed by the user and to activate the locking mechanism of the door assembly to engage a locking feature corresponding to the item receptacle column containing the at least one item receptacle to be accessed by the user.

6. The dispenser of claim 1, wherein the plurality of locking features are defined as recesses defined within a portion of the housing and aligned with corresponding item receptacle columns; and the locking mechanism comprises a solenoid configured to selectively engage one of the recesses to prevent the door assembly from moving relative to the housing.

7. The dispenser of claim 6, wherein the housing further comprises a horizontal guide member extending across the access opening and wherein the recesses are defined along the horizontal guide member.

8. The dispenser of claim 7, wherein the horizontal guide member is positioned between a first subset of item receptacles positioned above the horizontal guide member and a second subset of item receptacles positioned below the horizontal guide member.

9. The dispenser of claim 1, wherein the door assembly comprises a rigid frame laterally moveable across the access opening.

10. The dispenser of claim 1, wherein the door assembly further comprises a moveable member defining at least one aperture extending through the movable member, wherein the movable member is configured to move vertically behind the at least one access door and the aperture is configured for alignment with at least one item receptacle to permit access to contents of the at least one item receptacle through the door assembly.

11. The dispenser of claim 1, further comprising a control system comprising one or more processors configured to:

detect when the door assembly is in the moveable configuration; and configure the at least one access door to the locked configuration when the door assembly is in the moveable configuration.

12. The dispenser of claim 1, further comprising a control system comprising one or more processors configured to:

detect when the door assembly is in the locked configuration; and configure the at least one access door to the unlocked configuration when the door assembly is in the immobile configuration.

13. The dispenser of claim 1, wherein the at least one access door comprises:

a first access door operatively connected to the door assembly and adjustable between a locked configuration and an unlocked configuration, and wherein the first access door permits access through the door assembly to one of a first subset of item receptacles when in the unlocked configuration; and a second access door operatively connected to the door assembly and adjustable between a locked configuration and an unlocked configuration, and wherein the second access door permits access through the door assembly to one of a second subset of item receptacles when in the unlocked configuration.

14. The dispenser of claim 13, wherein the first access door is positioned above the second access door.

15. The dispenser of claim 1, wherein the access assembly comprises a first flexible barrier extending from a first side of the door assembly to a first side of the access opening and a second flexible barrier extending from a second side of the door assembly to a second side of the access opening and wherein the first flexible barrier, the second flexible barrier, and the door assembly collectively extend across the entire access opening of the housing.

16. The dispenser of claim 1, wherein the housing comprises an upper horizontal support member, and wherein the door assembly is configured to slide along the upper horizontal support member of the housing.

17. The dispenser of claim 16, wherein the housing comprises a lower horizontal support member, and wherein the door assembly is configured to slide along the upper horizontal support member and the lower horizontal support member.

* * * * *